United States Patent [19]

Garland et al.

[11] 3,994,638

[45] Nov. 30, 1976

[54] OSCILLATING ROTARY COMPRESSOR

[75] Inventors: Milton W. Garland, Waynesboro; F. Michael Laucks, Chambersburg; Zoltan A. Mandy, Waynesboro, all of Pa.

[73] Assignee: Frick Company, Waynesboro, Pa.

[22] Filed: Dec. 9, 1975

[21] Appl. No.: 639,037

Related U.S. Application Data

[63] Continuation-in-part of Ser. No. 501,736, Aug. 29, 1974, abandoned.

[52] U.S. Cl. ..... 418/216; 418/217; 417/202; 417/299; 417/310

[51] Int. Cl.[2] ..... F03C 3/00

[58] Field of Search ..... 418/216, 217; 417/24, 417/202, 299, 310

[56] References Cited

UNITED STATES PATENTS

| | | | |
|---|---|---|---|
| 250,722 | 12/1881 | Fischer | 418/216 |
| 805,140 | 11/1905 | Jarvis | 418/216 |
| 827,870 | 8/1906 | Jarvis | 418/216 |
| 878,600 | 2/1908 | Berrenberg | 418/216 |
| 1,172,692 | 2/1916 | Fanning | 418/216 |
| 1,654,883 | 1/1928 | Jaworowski | 418/216 |
| 1,665,460 | 4/1928 | Hollander et al. | 417/202 |
| 1,690,728 | 11/1928 | Jaworowski | 418/216 |
| 2,284,980 | 6/1942 | Mantle | 417/299 |
| 2,948,230 | 8/1960 | Shelton | 418/216 |
| 3,948,147 | 4/1976 | Sawer et al. | 417/299 |

*Primary Examiner*—C. J. Husar
*Attorney, Agent, or Firm*—A. Yates Dowell, Jr.

[57] ABSTRACT

Rotary apparatus for compressing and discharging fluid within a container. The apparatus includes an oscillating rotor or cam-like projection of substantially constant thickness in the plane of the longitudinal axis of the housing which cooperates with a sliding partition to define multiple compartments into which fluid is introduced during a portion of the rotation of the rotor or projection and is compressed during another portion of rotation of the rotor or projection.

4 Claims, 14 Drawing Figures

OSCILLATING ROTARY COMPRESSOR

CROSS REFERENCE TO RELATED APPLICATION

This application is a continuation-in-part of application Ser. No. 501,736 filed Aug. 29, 1974 and now abandoned.

BACKGROUND OF THE INVENTION

1. Field of the Invention

This invention relates generally to fluid compressors and relates particularly to oscillating rotary compressors having a continuous cam-like projection with spaced side walls of sinusoidal configuration for moving at least one partition lengthwise in such a manner that fluid to be compressed is introduced into a housing when the projection is rotated and such fluid is compressed and discharged from the housing by the rotation of such projection.

2. Description of the Prior Art

Heretofore many efforts have been made to provide an oscillating rotary compressor having a shaft with a reversing outwardly projecting helical-like blade or projection located within a housing and a partition engageable with the blade so that rotation of the shaft causes the blade to move the partition endwise of the housing to permit fluid to be introduced into the housing, compressed and discharged therefrom. Ordinarily the partition is provided with movable seals which engage opposite sides of the blade for providing a seal to prevent the passage of air or other compressible fluid from one side of the partition to the other. These seals have been necessitated by the blade normally being of constant thickness in a plane at right angles to the surfaces of the blade. Some examples of the prior art are the patents to Hula U.S. Pat. No. 783,865; Jarvis U.S. Pat. No. 805,140 and 827,870; Fanning U.S. Pat. No. 1,172,692; Jaworowsky U.S. Pat. Nos. 1,654,883, 1,690,727 and 1,690,728; and Shelton U.S. Pat. No. 2,948,230.

Additionally, some prior art devices such as the patent to Phillips U.S. Pat. No. 2,990,782 have been provided in which the thickness of the blade has varied in accordance with the point of contact between the blade and the sealing structure carried by the movable partition.

SUMMARY OF THE INVENTION

The present invention is embodied in an oscillating rotary compressor including a shaft located within a housing having a cylindrical compartment with spaced generally parallel end walls. Such shaft has an outwardly extending continuous cam-like projection or rotor with sinusoidal side walls which define internal and external apices with each of the external apices forming a sliding seal with the end walls of the compartment. At least one partition is slidably mounted within the housing axially of the shaft. The partition has a slot of a size to snugly receive the cam-like projection or rotor in such a manner that the partition is moved endwise when the shaft is rotated. The cam-like projection is of a constant thickness along the plane of the axis of the shaft and cooperates with the partition to define a pair of pockets on opposite sides of the projection which progressively open and close as the shaft is rotated. Inlet and outlet means are provided for introducing compressible fluid into each pocket and discharging fluid under pressure from each pocket when the shaft is rotated.

It is an object of the invention to provide an oscillating rotary compressor having a shaft with a continuous cam-like projection or rotor extending outwardly therefrom into sliding engagement with the cylindrical walls of a compartment and such projection has sinusoidal side walls defining external apices which slidably engage the end walls of the compartment. The projection is of a constant thickness along the plane of the axis of the shaft and cooperates with a sliding partition to progressively open and close a pair of pockets to compress the fluid.

DESCRIPTION OF THE PREFERRED EMBODIMENTS

Figure 1:
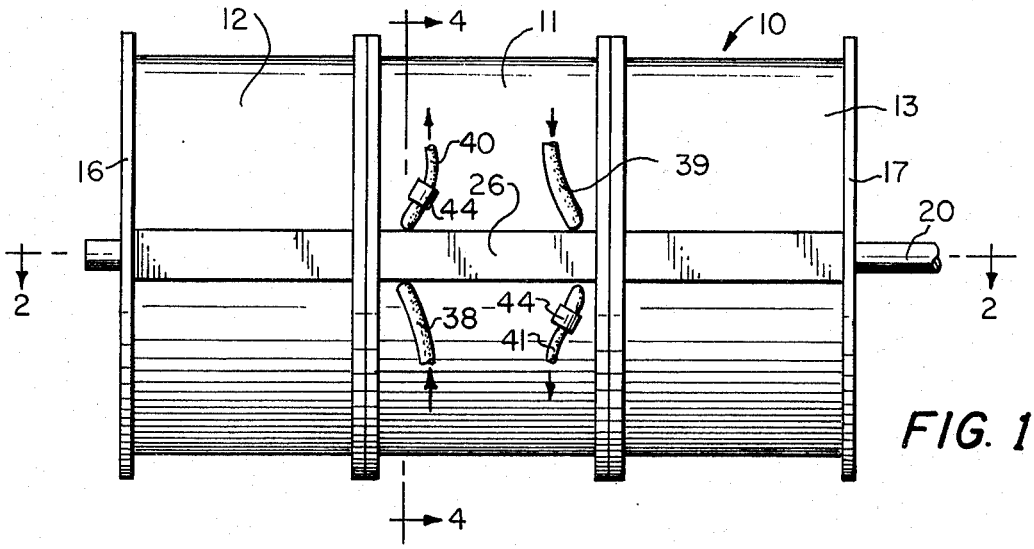
FIG. 1 is a side elevation illustrating one embodiment of the invention.
Figure 2:
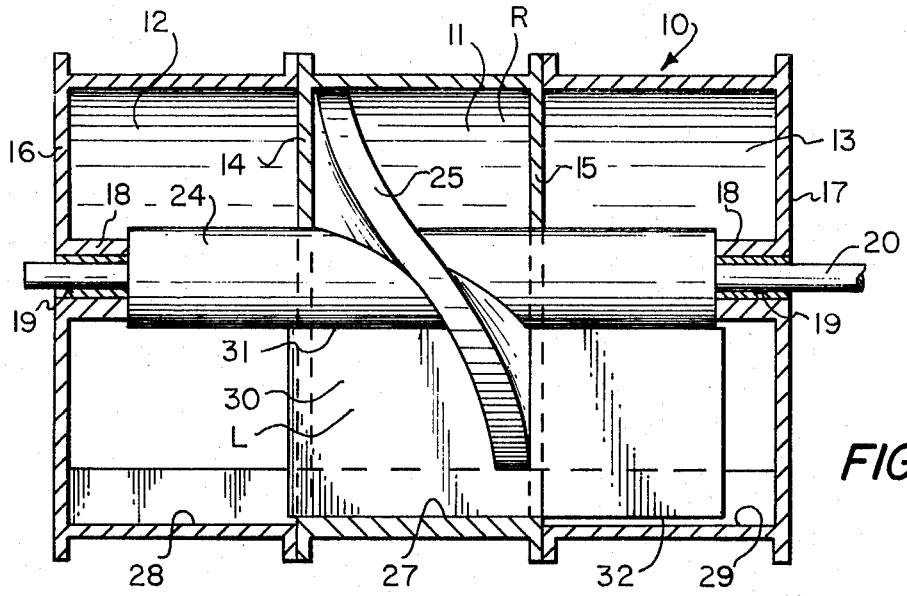
FIG. 2 is a longitudinal section on the line 2—2 of FIG. 1 illustrating the cam-like projection in a first position.
Figure 3:
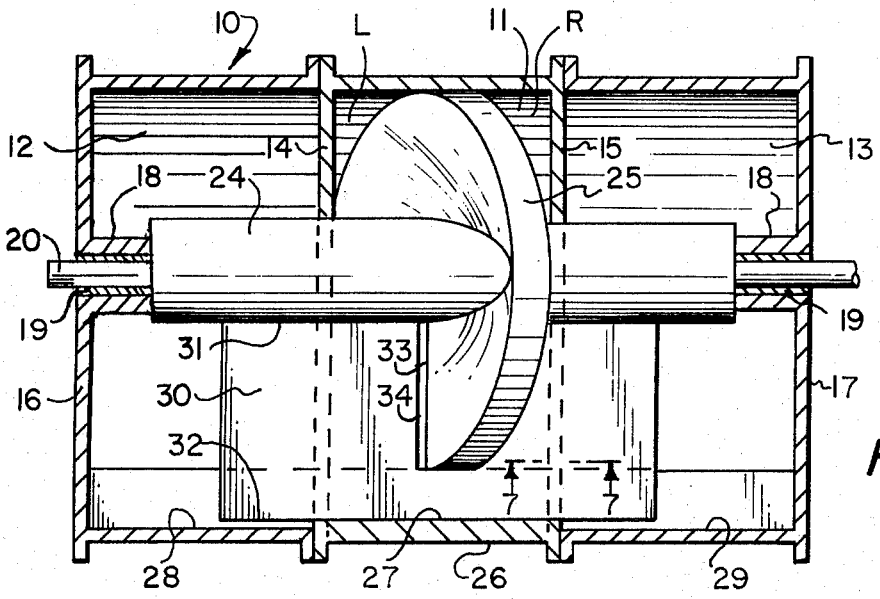
FIG. 3 is a longitudinal section similar to FIG. 2 illustrating the cam-like projection in a second position.

With continued reference to the drawings, a housing 10 is provided having a central compartment 11 with a generally cylindrical bore and a pair of end compartments 12 and 13 arranged along a common axis. The central compartment is separated from the end compartments by parallel inner walls 14 and 15 which extend entirely across the bore of the housing 10 and normal to the axis thereof. The end compartments 12 and 13 are provided with end walls 16 and 17, respectively, each of which is provided with an inwardly extending boss 18 having a bearing or bushing 19 disposed generally axially of the compartments. A drive shaft 20 is rotatably supported by the bearing 19 and such shaft is adapted to be driven in any desired manner, as by a power plant (not shown).

Figure 8:
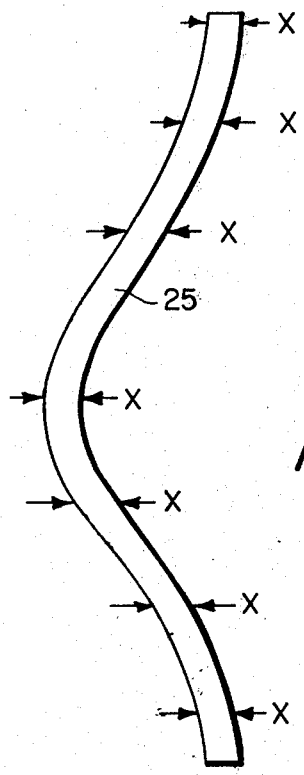
FIG. 8 is a schematic layout of the projection.

An elongated hub 24 is fixed to the shaft 20 within the housing 10 and the opposite ends of such hub engage the bosses 18 to prevent axial movement of the hub. If desired, thrust bearings (not shown) may be located between the ends of the hub 24 and the bosses 18 to reduce frictional losses. Within the central compartment 11, a continuous cam-like projection or rotor 25 is integrally connected to the hub 24 and has a pair of spaced side walls and a crown. The cam-like projection 25 is constructed so that the side walls are disposed at right angles to the cylindrical surface of the hub and the axial position of the side walls have a sinusoidal relationship determined by their angular position on the hub. The sinusoidal cam-like projection defines internal and external apices at opposite ends of the hub 24 which provide a righthand pocket R on one side of the projection and a lefthand pocket L on the other side. The crown of the cam-like projection is in sliding sealing engagement with the periphery of the cylindrical bore of the central compartment 11 and the external apices of the projection are in sliding sealing engagement with the inner walls 14 and 15 to separate each of the pockets R and L into two sections whose volume continuously change as the shaft rotates. The projection 25 has a predetermined constant thickness X (FIG. 8) in a plane parallel to the axis of the hub; however, due to the sinusoidal configuration, the thickness of the projection may vary in a plane normal to the side walls thereof.

With particular reference to FIGS. 1–5, the housing 10 is provided with an enlargement 26 located along one side and extending substantially the full length of the housing. The enlargement 26 is provided with a groove or recess 27 extending outwardly from the bore of the central compartment 11 and is provided with grooves or recesses 28 and 29 in the end compartments 12 and 13, respectively. As illustrated best in FIG. 3, the grooves 27, 28 and 29 are in alignment with each other and the grooves 28 and 29 are slightly deeper than the groove 27.

A generally flat rectangular partition 30 is provided having generally parallel inner and outer edges 31 and 32 and such partition is slidably mounted within the grooves 27, 28 and 29. The outer edge 32 of the partition slidably engages the bottom of the groove 27 and is spaced slightly from the bottoms of the grooves 28 and 29 to prevent fluid under pressure from passing around the partition in the central compartment while reducing frictional losses in the end compartments. The inner edge 31 of the partition slidably and sealingly engages the hub 24 in a manner to prevent the passage of fluid under pressure between the same.

The partition 30 has a slot or mouth 33 extending outwardly from the inner edge 31 and such mouth is adapted to receive and slidably engage the sides and crown of the cam-like projection 25. Along opposite sides or lips of the mouth 33, the partition is provided with tapered portions 34 terminating in sharp edges 35 extending substantially the full length of the mouth. The sharp edges 35 are spaced apart a constant distance indicated by the letter X in FIG. 7 which is substantially equal to the thickness of the projection 25. The sharp edges 35 are located substantially centrally of the thickness of the partition 30 and are adapted to slidably engage opposite sides of the projection 25 with a sufficiently close tolerance to substantially restrict the flow of fluid under pressure from one side of the partition to the other.

Figure 7:
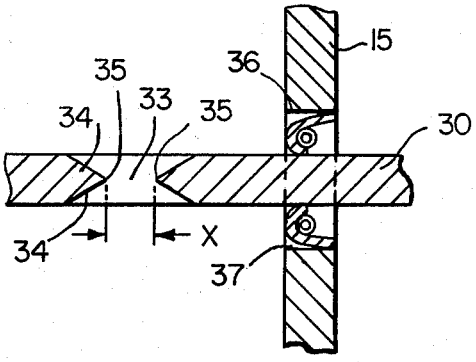
FIG. 7 is an enlarged fragmentary section on the line 7—7 of FIG. 3 with the cam-like projection removed.
Figure 9:
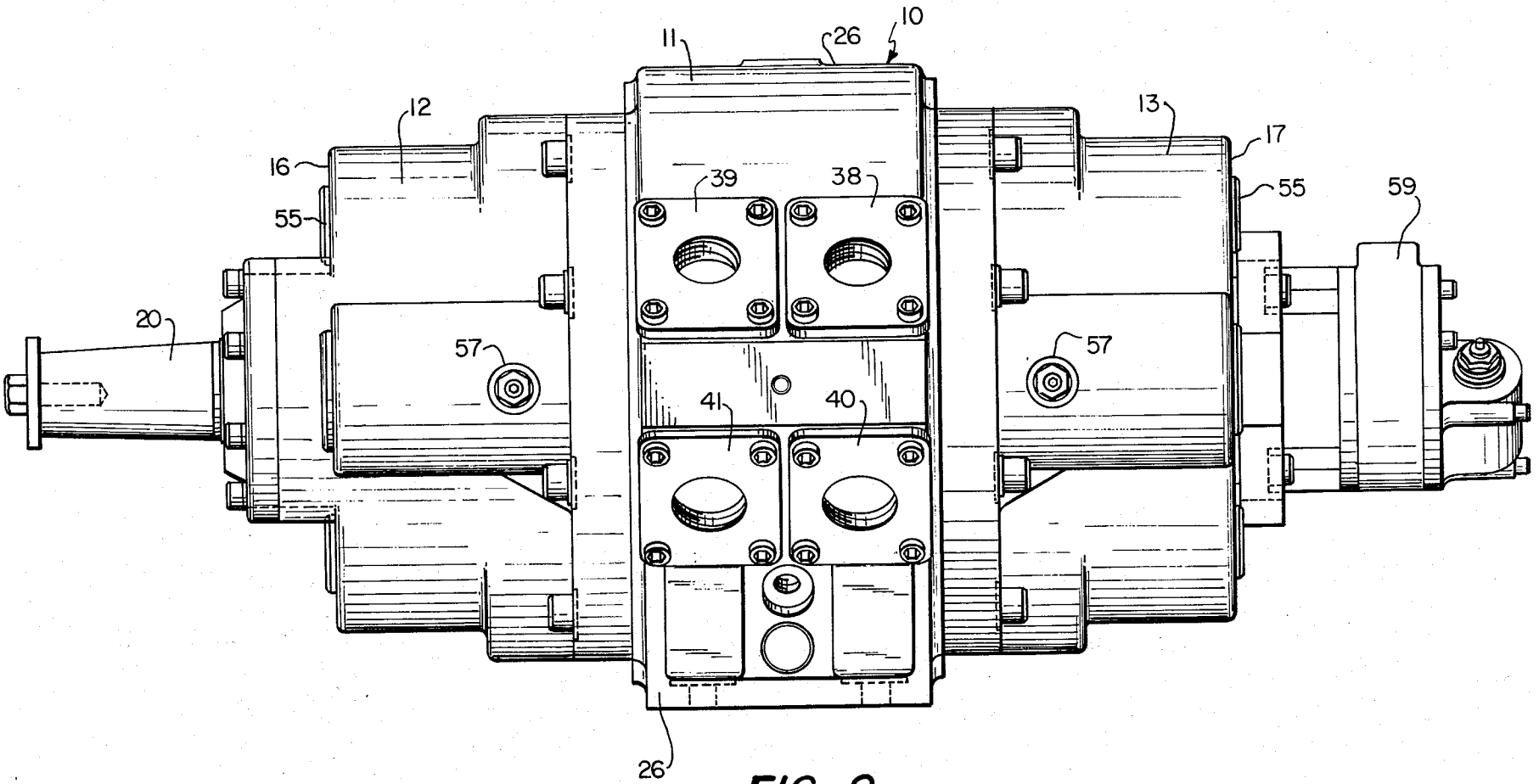
FIG. 9 is a side elevation illustrating another embodiment.
Figure 10:
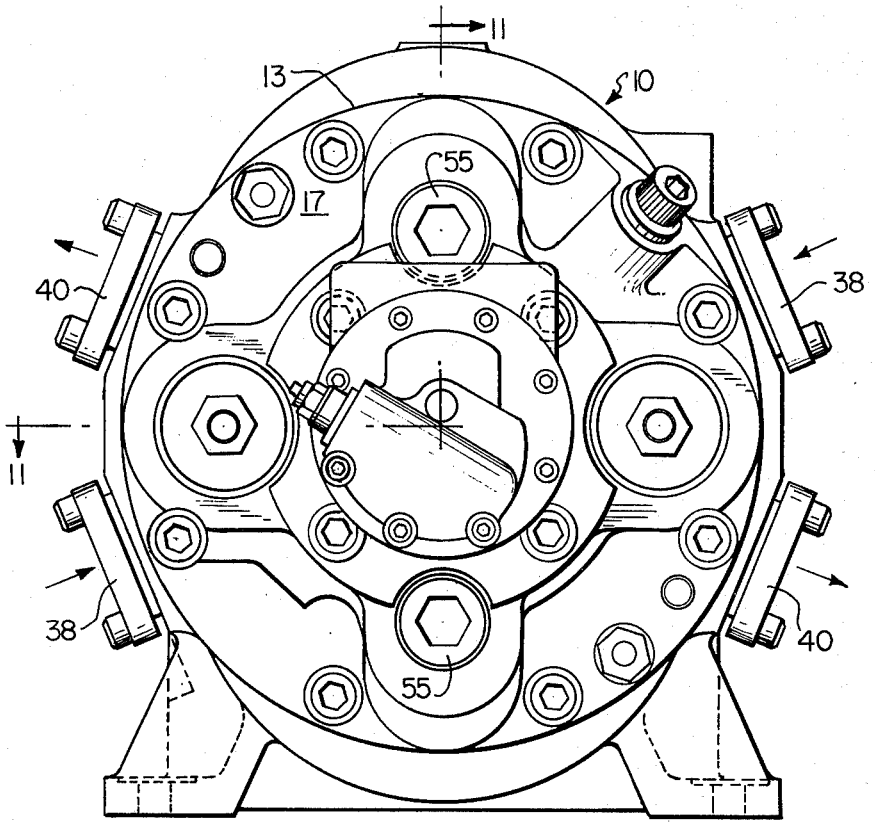
FIG. 10 is an end view thereof.

With particular reference to FIG. 7, each of the inner walls 14 and 15 is provided with an elongated opening 36 through which the partition 30 extends and each of such openings has a pair of sealing members 37 engaging the upper and lower surfaces of the partition to prevent the passage of fluid under pressure from the central compartment 11 into the end compartments 12 and 13. In most compressors having moving parts, such parts are supplied with a film of oil or the like to reduce frictional wear as well as to substantially reduce the build-up of heat. In the present invention, it is contemplated that oil will be supplied to the moving parts to reduce frictional engagement and heat as well as to assist in forming a seal between the relatively movable members. Accordingly, it is contemplated that the inner walls 14 and 15 could be provided with openings 36 of a size to slidably and sealingly receive the partition 30 with a film of oil thereon so that the sealing members 37 could be omitted.

Figure 4:
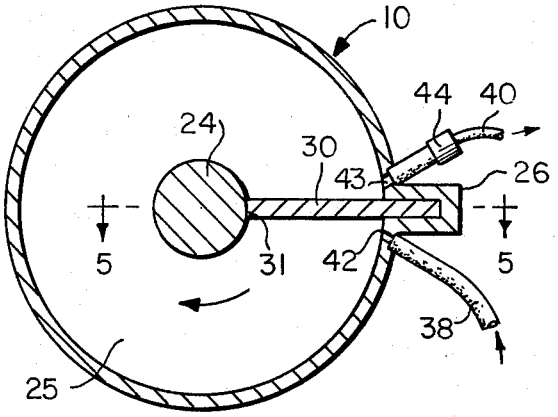
FIG. 4 is a vertical section on the line 4—4 of FIG. 1.
Figure 6:
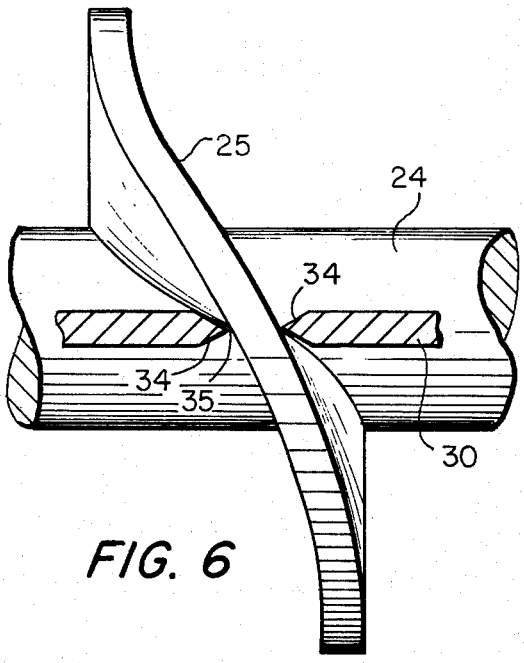
FIG. 6 is a section on the line 6—6 of FIG. 5.
Figure 5:
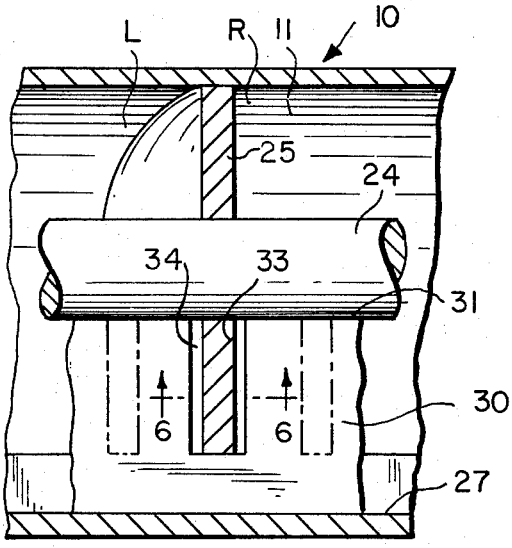
FIG. 5 is an enlarged fragmentary section on the line 5—5 of FIG. 4.

With particular reference to FIGS. 1 and 4, a pair of inlets 38 and 39 are provided at opposite ends of the central compartment 11 and on opposite sides of the enlargement 26 for introducing air or other compressible fluid into the central compartment. A pair of fluid outlets 40 and 41 are provided at opposite ends of the central compartment 11 on opposite sides of the enlargement 26 and in opposed relationship to the inlets 38 and 39. Each of the inlets 38 and 39 communicates with the interior of the central compartment through an opening 42 and each of the outlets 40 and 41 communicates with the interior of the central compartment by openings 43 (FIG. 4). Preferably, each of the outlet openings 43 has a pressure operated discharge valve member 44 of conventional construction which prevents the discharge of air from the central compartment until a predetermined pressure has been reached within the high pressure portions of the pockets R and L.

In the operation of this embodiment of the device, the drive shaft 20 is rotated by the power plant to cause rotation of the projection 25 which causes the partition 30 to move back and forth within the grooves 27, 28 and 29 substantially lengthwise of the housing 10. Since the ends of the projection are in sliding engagement with the inner walls 14 and 15, pressure and vacuum sides of varying capacities are formed in each of the pockets L and R. As soon as one end of the projection passes the opening 42 of the inlet 38, the vacuum side of the pocket L begins to enlarge so that air or other fluid passes through the inlet to fill the pocket. Simultaneously fluid within the pocket L on the pressure side of the end seal begins to be compressed. Continued rotation of the projection 30 causes fluid under atmospheric pressure to continue entering the vacuum side of the pocket while fluid on the pressure side continues to be compressed. When the compressed fluid reaches a pressure sufficient to open the valve member 44, the compressed fluid is discharged from the pressure side of the pocket L while the vacuum side continues to draw fluid through the inlet 38. The discharge of compressed fluid and the introduction of fluid under atmospheric pressure into the pressure and vacuum sides of the pocket L continues until the end seal of the projection passes the outlet 40 at which time all of the fluid in the pressure side of the pocket is discharged. When the end seal passes through the mouth 33, it immediately passes the inlet 38 and interrupts the flow of fluid into the vacuum side of the pocket to cause such side to become the pressure side. Simultaneously, the portion of the pocket which was the pressure side becomes the vacuum side into which fluid is introduced. With this structure, fluid under atmospheric pressure is introduced into the pocket substantially continuously while compressed fluid is discharged from the pocket intermittently. While the fluid is being introduced into a portion of the pocket L, compressed and discharged therefrom, the partition 30 is sliding back and fourth within the housing and fluid is being introduced into the pocket R through the inlet 39 where it is compressed and discharged through the outlet 41 in timed relationship with the operation of the pocket L.

With particular reference to FIGS. 9–14, another embodiment of the apparatus is illustrated in which a pair of partitions 30 are disposed on opposite sides of the shaft 20. In this embodiment a pair of enlargements 26 are located on opposite sides of the housing 10 and each of such enlargements is provided with a guide 45 which slidably receives one of the partitions 30.

Figure 13:
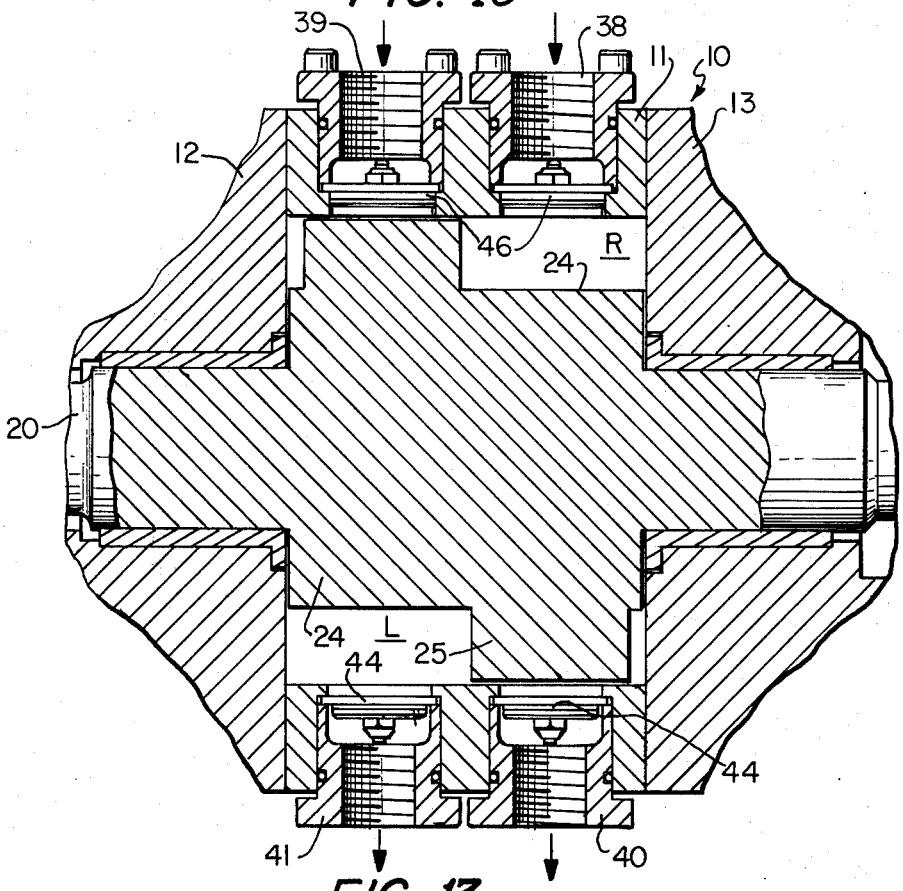
FIG. 13 is a section on the line 13—13 of FIG. 12.
Figure 11:
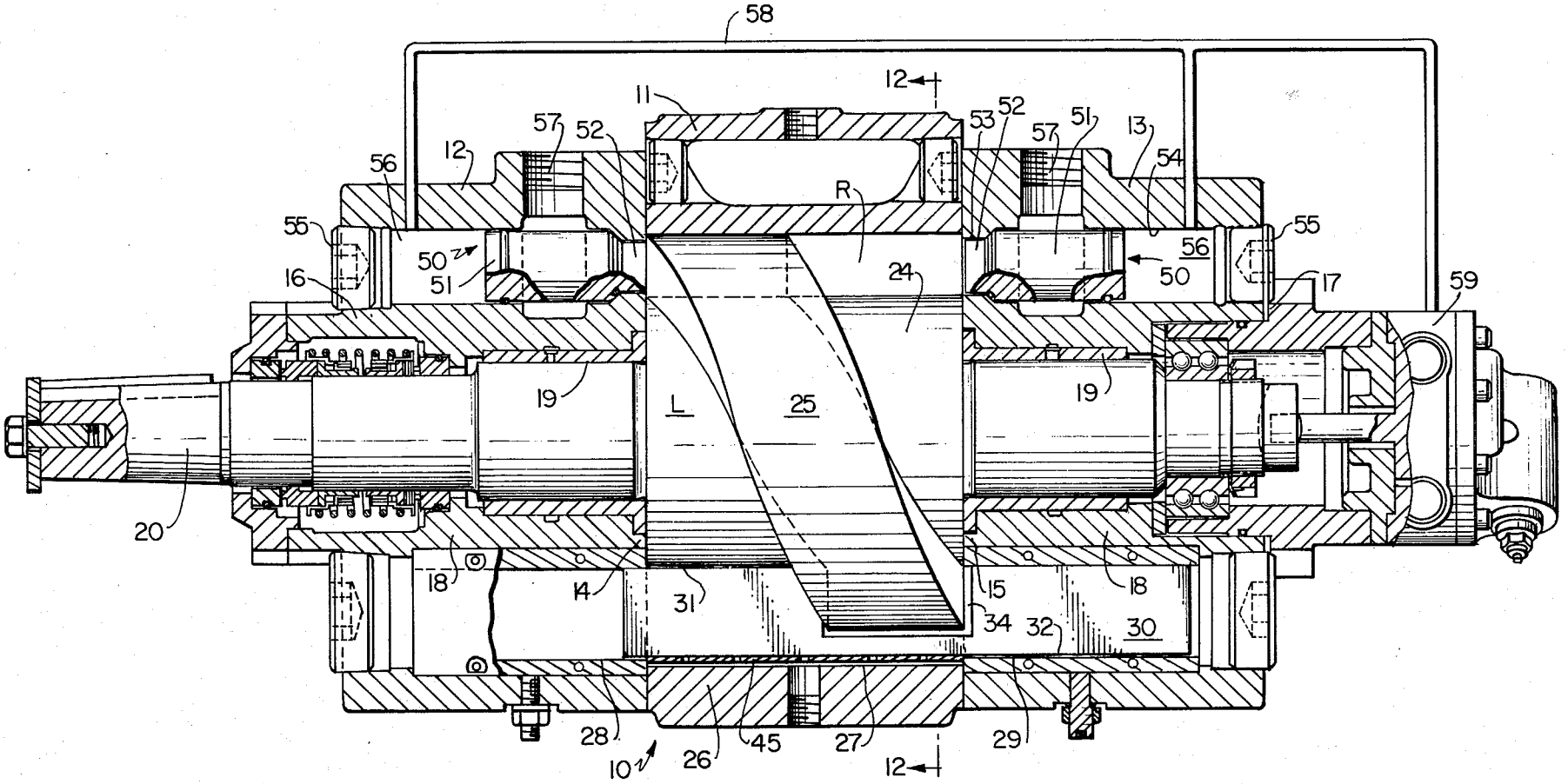
FIG. 11 is a section on the line 11—11 of FIG. 10.
Figure 12:
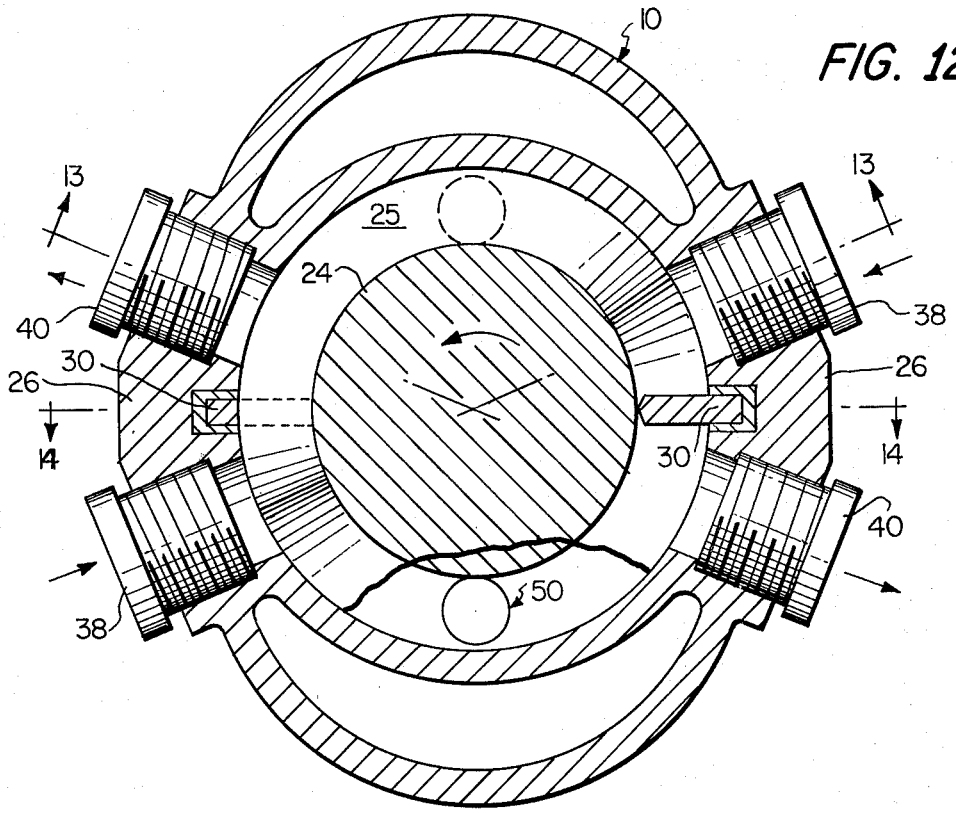
FIG. 12 is a section on the line 12—12 of FIG. 11.

As illustrated best in FIGS. 12 and 13, a first pair of inlets 38 are located on opposite sides of the housing 10 and each of such inlets 38 is disposed adjacent to one of the partitions 30 and at one end of the central compartment to provide communication between a source of compressible fluid and the pocket L. A second pair of inlets 39 are provided substantially in longitudinal alignment with the inlets 38 and located at the opposite end of the central compartment for introducing compressible fluid into the pocket R.

A first pair of fluid outlets 40 are located at opposite sides of the housing 10 and at the same end of the central compartment as the inlets 38 but being disposed on opposite sides of the partitions 30 for providing communication between the pocket L and the exterior of the housing. A second pair of outlets 41 are located at the opposite end of the central compartment for providing communication between the pocket R and the exterior of the housing. With particular reference to FIG. 13, each of the inlets 38 and 39 is provided with a conventional suction valve 46 while each of the outlets 40 and 41 has a pressure operated discharge valve 44.

Preferably each of the pockets R and L includes a pair of opposed unloader valves 50 which remain closed as long as the demand of the compressor output is equal to or greater than the capacity. However, when the capacity exceeds the demand, the unloader valves operate when the pressure within the central compartment exceeds a predetermined value so that the compressed fluid is discharged either to atmosphere or to the low pressure supply for the compressor. Each of the unloader valves includes a capacity control piston 51 having a reduced portion 52 at its inner end. The housing 10 is provided with a bore 53 and a concentric counterbore 54 for each of the unloader valves and the piston 51 of each valve is slidably mounted within the counterbore 54. The outer end of each counterbore is closed by a plug 55 and defines a pressure chamber 56 between the piston 51 and the plug 55. An exhaust port 57 extends through the housing 10 substantially in alignment with the piston 51 in such a manner that the exhaust port ordinarily is closed and sealed by the piston.

Normally when the compressor is in operation, fluid under predetermined pressure is maintained within the pressure chamber 56 to urge the piston 51 toward the central compartment 11 so that the reduced end of the piston is flush with the inner surfaces of the walls 14 and 15. Pressurized fluid is supplied to the pressure chamber 56 through a line 58 connected to a pump 59 which is mounted on the housing 10 and is driven by the shaft 20. It is noted that at the beginning of operation of the compressor, the pump 59 has been idle and therefore the pressure within the pressure chamber 56 has been relieved and the piston 51 is easily moved lengthwise of the counterbore 54.

As the compressor begins operation, fluid within the pockets R and L begins to become compressed and such slightly pressurized fluid forces the piston 51 outwardly away from the central compartment to expose the exhaust port 57 to the bore 53 so that any fluid within the central compartment is discharged through the port 57 and the compressor starts under substantially no-load conditions. However, operation of the shaft 20 drives the pump 59 which forces fluid under pressure into the pressure chambers 56 so that the piston 51 is moved lengthwise toward the central compartment to block the escape of fluid from such central compartment and thereafter the fluid introduced into the pockets R and L is compressed and discharged through the discharge valves 44. The unloader valves 50 additionally function as relief safety valves in the event that slugging occurs within the central compartment of the compressor.

Figure 14:
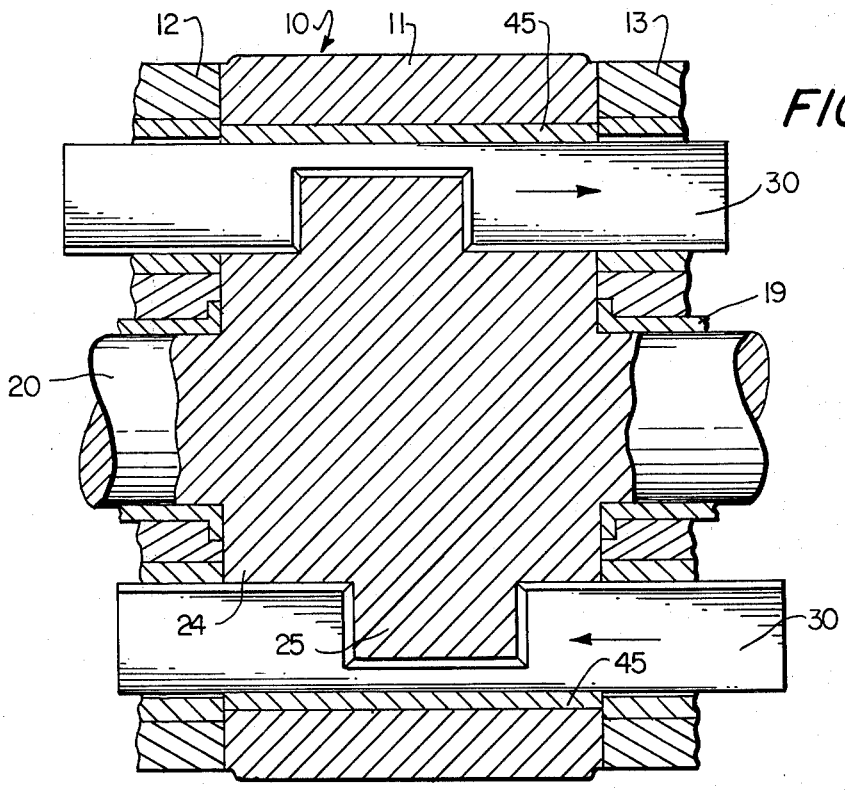
FIG. 14 is a fragmentary section on the line 14—14 of FIG. 12.

In the operation of this embodiment, due to the sinusoidal relationship between the cam-like projection 25 and the hub 24, the partitions 30 on opposite sides of the housing are moving in opposite directions, as indicated by the arrows in FIG. 14. As soon as the external apex of the pocket L passes the inlet 38, as illustrated in FIG. 12, the portion of the pocket to the left of the apex and between the apex and the partition 30 on the opposite side of the housing becomes a pressure pocket, while the portion of the pocket between the inlet 38 and the partition on the right of the housing becomes a suction pocket. Simultaneously the portion of the pocket L below the partitions 30 communicate with the other inlet 38 as well as the discharge outlet 40; however, since the area of the pocket below the partitions is not being pressurized at this time, such pocket merely fills with compressible fluid.

Continued rotation of the drive shaft 20 causes the pressurized pocket to be reduced in size so that the fluid therein is compressed and when such fluid reaches a predetermined pressure, the discharge valve 44 opens to discharge the fluid under pressure from such pocket. When the external apex of the pocket L passes through the mouth 33 of the partition on the opposite side of the housing, the direction of movement of the partitions 30 is reversed and as soon as the external apex passes the inlet 38 on the left of FIG. 12, the lower portion of the pocket becomes the pressure pocket so that fluid under pressure is discharged from the discharge valve on the lower righthand side of FIG. 12. As the cam-like projection 25 alternately compresses the fluid in the upper and lower portions of the pocket L, the pocket R at the other end of the hub 24 is operating in an opposite manner with the inlets 39 and the outlets 41 so that compressible fluid under pressure is being discharged simultaneously from the outlets 40 and 41 at opposite ends of the central compartment to obtain a balanced condition within the compressor.

We claim:

1. An oscillating rotary compressor comprising a housing having a cylindrical bore, said housing having a pair of spaced parallel inner walls and a pair of end walls defining a central compartment and a pair of end compartments, a drive shaft having an enlarged portion and reduced end portions rotatably mounted along the axis of said housing, an inwardly extending boss on each of said end walls for rotatably receiving the reduced portions of said shaft, said enlarged portion of said shaft engaging said bosses to substantially prevent longitudinal movement thereof, a continuous cam-like projection mounted on said drive shaft and having side walls extending radially outwardly and a crown which slidably engages the bore of said central compartment, the side walls of said projection having sinusoidal configurations defining internal and external apices at each end of the enlarged portion of said shaft, said external apices forming end seals which slidably engage said pair of spaced inner walls, said projection having a constant thickness in a plane along the axis of said drive shaft and a variable thickness normal to the plane of the side walls of said projection, said housing having an enlargement along at least one side, said enlargement having an inwardly opening groove extending substantially the full length of said housing, the grooves in said end compartments being deeper than the groove in said central compartment, a partition slidably mounted in the groove of said enlargement and extending through both inner walls of said housing, said partition being radially disposed relative to said drive shaft and having one edge slidably engaging said shaft, the opposite edge of said partition slidably engaging the groove in said central compartment and spaced from the grooves in said end compartments, each of said inner walls having an opening to permit said partition to pass therethrough, said partition having a mouth extending outwardly from said one edge to the bore of said housing, said mouth including horizontally opposed sharp edges spaced apart a distance corresponding to the constant thickness of said projection and slidably engaging opposite side walls thereof, said projection defining a pair of pockets within said central compartment, the end seals of said projection separating each pocket into pressure and suction sides, inlet means extending into said housing and communicating with the suction side of each of said pockets for substantially continuously introducing fluid thereinto at a first predetermined pressure, outlet means extending into said housing and communicating with the pressure side of each of said pockets for discharging fluid therefrom, and said outlet means having pressure operated means which permit fluid to be discharged only when the fluid reaches a second predetermined pressure which is higher than said first predetermined pressure, whereby fluid is introduced into the suction sides of each of the pockets substantially continuously and fluid under pressure is discharged intermittently from the pressure side of each of said pockets.

2. The structure of claim 1 including a pair of enlargements located on opposite sides of said housing, a partition slidably mounted in each of said enlargements, each partition having a mouth which slidably engages said projection, and inlet and outlet means located adjacent to each of said partitions.

3. The structure of claim 1 including at least one unloader valve means for each of said pockets so that said compressor may begin operation under no-load conditions.

4. The structure of claim 1 including seal means in each of the openings of said inner walls through which said partition passes to substantially prevent the passage of fluid.

* * * * *